US005201447A

United States Patent [19]

Bumb et al.

[11] Patent Number: 5,201,447

[45] Date of Patent: Apr. 13, 1993

[54] QUICK RELEASE HOLSTER

[75] Inventors: George Bumb; Gerald L. Campagna, both of San Jose, Calif.

[73] Assignee: Bumb & Associates, San Jose, Calif.

[21] Appl. No.: 777,613

[22] Filed: Oct. 16, 1991

[51] Int. Cl.[5] ..... F41C 33/02

[52] U.S. Cl. ..... 224/243; 224/252; 224/911; 224/901

[58] Field of Search ..... 224/243, 244, 911, 912, 224/252, 191, 242, 246, 901

[56] References Cited

U.S. PATENT DOCUMENTS

| | | | |
|---|---|---|---|
| 3,200,021 | 8/1965 | Clark | 224/911 |
| 3,565,303 | 2/1971 | Kippen | 224/911 |
| 4,312,466 | 1/1982 | Clark | 224/243 |
| 4,485,947 | 12/1984 | Cook | 224/243 |
| 4,858,800 | 8/1989 | Holtzclaw, Jr. et al. | 224/243 |
| 5,018,654 | 5/1991 | Rogers et al. | 224/244 |
| 5,054,670 | 10/1991 | Gallagher | 224/911 |

*Primary Examiner*—Linda J. Sholl

*Attorney, Agent, or Firm*—Phillips, Moore, Lempio & Finley

[57] ABSTRACT

A holster is described that may be used for holding articles, such as a gun or a tool, in a relatively secure position at or near one's waist. The holster is configured so that it may be easily hooked over one's belt yet be removed simply and quickly. A pair of flexible straps are provided that permit various combinations of a hold-down for the article. The straps include a snap fastener to affix one to the other and hook and loop fasteners to fix the hold down straps to the holster pouch and belt retainer.

10 Claims, 2 Drawing Sheets

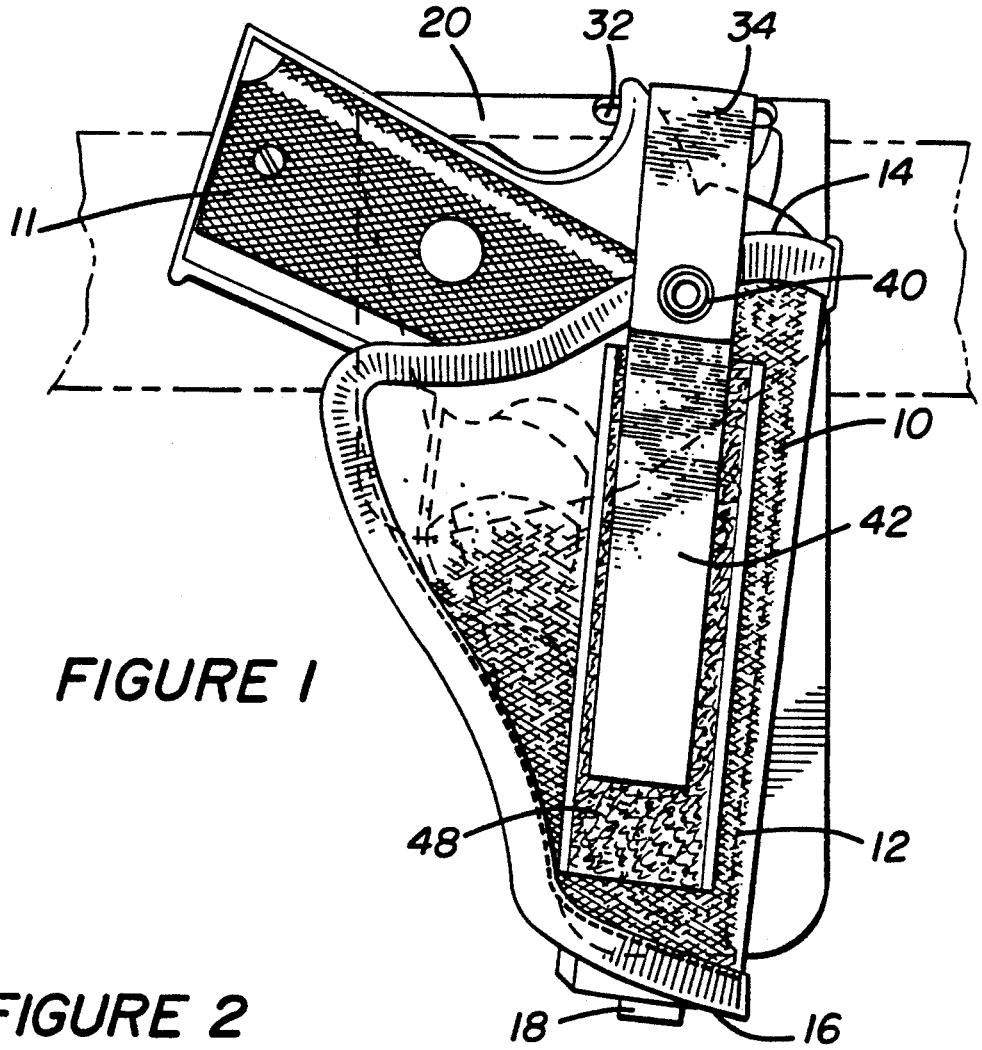
FIGURE 1
FIGURE 2
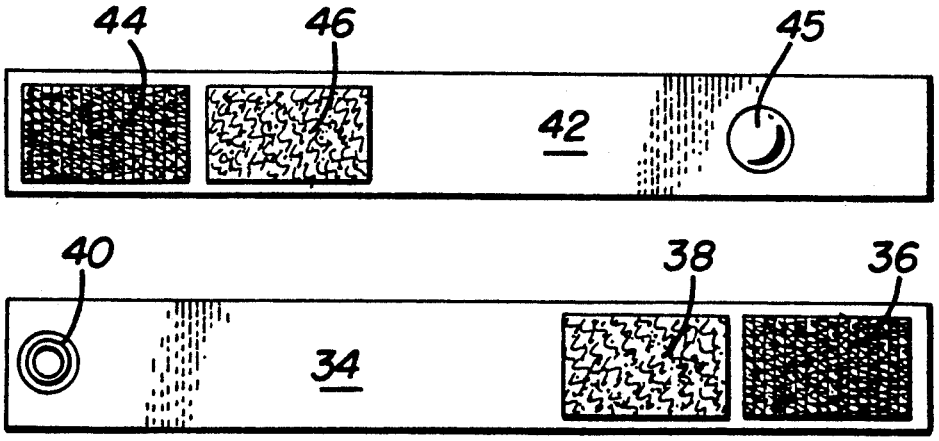
FIGURE 3

QUICK RELEASE HOLSTER

BACKGROUND OF THE INVENTION

The carrying of articles such as tools or a gun by a workman or a security guard is relatively common these days. The device for carrying the article such as a tool or a gun generally is called a holster and usually is affixed t the waist belt of the individual carrying the article or in the case of guns, by strapping or belts about one's chest and shoulder. This invention relates specifically to holsters affixed to the wearer's belt about his or her waistline. In particular, it relates to a holster which may be removed from one's person without unbuckling the belt and removing it from the belt loops.

Currently, holsters are generally affixed to a waist belt by means of a loop permanently affixed to the holster. In order to position the holster on the belt one must unbuckle the belt, remove it from at least some of the belt loops on the trousers and insert the belt through the loop on the back of the holster and then rethread the belt through the trouser loop. In certain instances a fitting can be affixed to the belt which in turn will be formed so that the holster can be snapped or in some manner affixed to that fitting. Military holsters of years past utilized a web belt having grommet holes therein. The holster was then affixed to the grommet holes but was not readily removable from the webbed belt. Finally, it is not uncommon to use a separate leather belt worn over the trouser belt with the holster mounted on the outer belt.

The problem with existing holsters arises when the wearer sits down particularly in an automobile. At that point the holster will not only interfere with movement of the individual in the seat but can become uncomfortable over a prolonged period of time.

Accordingly, it is a first object of this invention to provide a holster which is readily removable from one's belt and may be replaced thereon without unbuckling the belt or removing the belt from one's belt loops.

Further, the extraction of the article carried in the holster be it a gun or a tool, becomes somewhat difficult when the article must be secured in the holster by some means. Conventionally, this is done with a flap that forms a portion of the holster passing over the top of the article and then down along the outside of the holster to snap to the outer surface of the holster. This traditional method of securing the gun or tool in a holster has in some cases, been modified to a strap or the like, passing over the article and usually affixed at one end to the holster and then removably affixed at the other end on the outside of the holster by a snap or some sort of a button or the like. The objection to this type of fixture is that some times it is difficult to remove the article rapidly from the holster simply because the strap must first be undone usually in an awkward fashion. In some instances the user wishes to undo the strap with the downward motion of the hand to withdraw the article whereas in other instances, the user wishes to undo the strap on the upward motion which is subsequently combined with withdrawal of the article.

Accordingly, it is a second object of this invention to provide hold down strap means which may be disassociated one from the other by either a downward or an upward motion of the user's hands.

It is a further object of this invention to provide the quickly removable holster along with the convertible strap means.

Broadly stated, the invention is a holster assembly for use by a clothed person consisting of a semi-rigid pouch having an enlarged open upward end and a smaller lower end. The pouch is formed to receive an article in its enlarged open upper end. A rigid retainer is affixed to one side of the pouch for removably affixing the pouch to an article of clothing worn by the person. A separable strap is included comprising a first piece and a second piece. The first piece is removably fixable to the retainer while the second piece is removably fixable to the semi-rigid pouch. The first and second pieces are affixable one to the other when respectively fixed to the retainer and to the semi-rigid pouch whereby the article is retained in the semi-rigid pouch.

BRIEF DESCRIPTION OF THE DRAWINGS

FIG. 1 is a elevation view of the holster with a gun inserted therein.

FIG. 2 is the one of the two strap members utilized to retain the article or gun within the holster.

FIG. 3 is the other of the two straps utilized to retain the gun or article within the holster.

DETAILED DESCRIPTION OF THE PREFERRED EMBODIMENT

Figure 4:
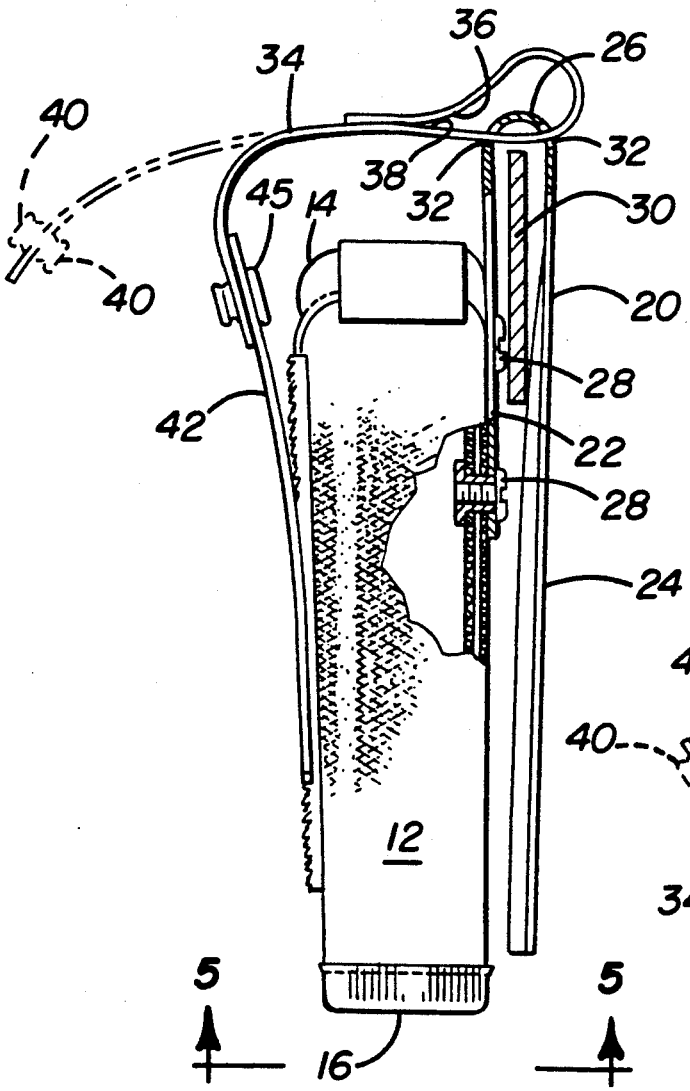
FIG. 4 is a side view of the holster shown in FIG. 1 without the article or gun.

Referring to FIG. 1, a holster 10 is shown. Inserted in holster 10 is an article such as a gun 11. It is to be understood that other articles such as drills, and the like are equally adaptable for insertion into the holster 10. The holster includes a semi-rigid pouch 12 and having an enlarged open upper end 14. A smaller open lower end 16 is provided also. The lower end 16 is opened so that the nose end or barrel end 18 of gun 11 may extend outwardly of the pouch 12. This lower open end is not critical to the invention however, the holster pouch 12 should be formed so that the article or gun 11 will not pass or fall through the out pouch.

The pouch 12 is affixed to a rigid retainer 20 which preferably is a U-shaped piece of metal having two downwardly extending legs 22 and 24 along with a cross member 26 which interconnects the two downwardly extending legs. The pouch 12 may be affixed to the shorter of the two downwardly extending legs 22 by rivets 28 or the like. As can be seen in FIG. 5, the longer of the two downwardly extending legs is concave with the concave surface being distal of pouch 12 and with the longer axis of the elongation oriented vertically as viewed in FIGS. 1 and 4. The purpose of the concavity in the downwardly extending leg 24 is to insure that the holster assembly is comfortable when used by over a prolonged period of time.

The downwardly extended leg 24 is formed so that it may be pulled over a belt 30 which forms a portion of the clothing of the wearer of the article or gun. The two legs 22 and 24 are pierced by coaxial elongated slots 32 better seen in FIG. 1. These elongated slots have the long axis parallel to the plane of the cross member 26. The concave surface 24 has its elongated axis perpendicular to the plane of the cross member 26.

Figure 5:
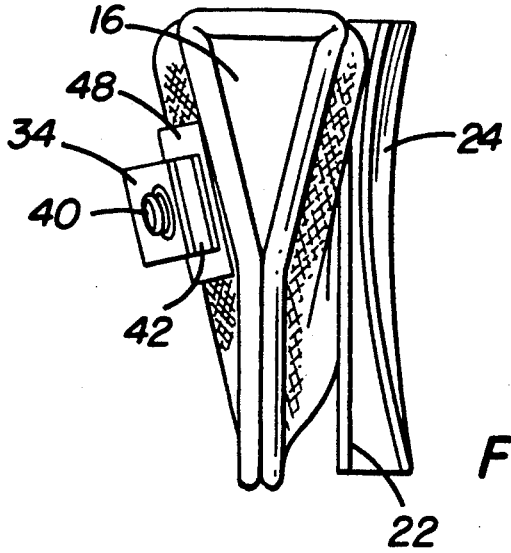
FIG. 5 is a sectional view taken at section line 5,5 in FIG. 4.

Referring now to FIG. 4, the hold down mechanism consists of first and second hold down pieces. The first piece 34 is shown in plan view in FIG. 3. At on end of piece 34 is a hook and loop fastener arrangement with the hook portion 36 adjacent to the end of piece 34 and the loop portion 38 adjacent to the hook portion 36. At the opposite end of strap or piece 34 is a male member of a snap fastening means. This male member 40 is a double sided snap as shown in FIG. 4. That is, the male portion of the snap fastening means is available on both sides of the strap 34. This purpose of this will become clear in the ensuing discussion.

Strap 34 is passed through the elongated slots 32 and doubled back upon itself so that the hook portion 36 may engage the loop portion 38 of piece 34.

The second piece 42 of the hold down strap assembly is shown in plan view in FIG. 2 and in side view in FIG. 4. Referring to FIG. 2, a hook and loop fastening system is also associated with first piece 42. The hook member 44 being close to one end of the second piece 42. A loop portion 46 is also included adjacent to hook portion 44 but distal of the first end of the first piece 42. Referring to FIG. 1, the loop portion 48 of hook and loop fastening means is affixed to pouch on the outer surface. This enables one to affix the second piece to the pouch by the hook portion of the hook and loop fastening means 44. At the end opposite the hook portion on second piece 42 is a female portion 45 of a snap fastening means. The female portion 45 has its socket on the side opposite of the hook and loop fastening means as shown in FIG. 2. Reference should be made to FIG. 4 to orient the female snap 45 in relation to the male snap 40.

In the configuration shown in FIGS. 1 and 4, it can be seen that the hold down strap assembly comprising the first and second pieces 34 and 42 is released by pulling upwardly on first piece 34 thereby disengaging male snap member 40 from the female socket 45 located on second piece 42. This permits rapid withdrawal of the article or gun 11 from the holster on the upward movement of the hand as it passes the holster.

Figure 6:
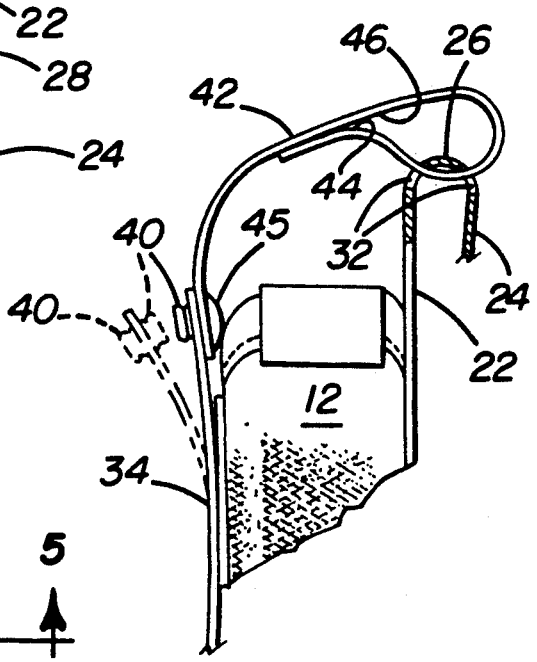
FIG. 6 is an illustration of an alternate way of utilizing the straps depicted in FIG. 2 and FIG. 3.

An alternative arrangement is shown in FIG. 6. In FIG. 6 the first piece 34 is affixed to the pouch 12 in a manner similar to the positioning described in relation to the second piece above. The second piece 42 is passed through the elongated openings 32 but in this instance it is doubled back under itself and affixed to itself by the hook and loop fastening means 44 and 46. The second side 40 of the male snap member is utilized in this position to engage the female snap socket 45. In this second method of using the hold down straps, the straps are disconnected on the downward motion past the holster while the article or gun is removed on the upward motion.

It is believed that operation of the invention is evident from the above description however, it is pointed out herein that the two pieces 34 and 42 may be positioned as shown respectively in FIG. 4 and FIG. 6 so that the release motion performed by the user is in the opposite direction. Should one wish to reverse that motion then it is a simple matter to reverse the straps.

Further, the retainer 24 is formed so that the entire assembly including the contained article or gun 11 may be withdrawn from the belt 30 of the user and placed to one side particularly when one is seated. Furthermore such withdrawal of the gun may be done at the end of one's workday without having to remove the belt.

This invention is limited only so far as the appended claims.

We claim:

1. A holster assembly for use with a clothed person, comprising:

a relatively semi-rigid pouch having an enlarged open upper end and a smaller lower end, said pouch formed to receive an article in its enlarged open upper end;

rigid retainer means affixed to one side of said pouch for removably affixing said pouch to an article of clothing worn by the person;

a separable strap comprising a first piece and a second piece wherein one of said first or second pieces is removably fixable to said retainer means and the other side of said first or second pieces is removably fixable to said semi-rigid pouch, said first piece and said second pieces fixable one to the other when respectively fixed to said retainer means and said semi-rigid pouch said rigid retainer means comprising a U-shaped member defining a first leg and a second leg, said first leg connected to said second leg by a cross member, said first and second leg each defining a co-axial elongated slot each slot defining a long axis, said coaxial elongated slots adjacent to said cross member with said long axis substantially parallel to the plane of said cross member and further wherein said pouch is affixed to said first leg.

2. The holster of claim 1 wherein the lower end of said pouch is open whereby a portion of said article may extend outwardly through said open lower end.

3. The holster of claim 1 wherein said second piece is fixable to said pouch by hook and loop fastening means, the hook portion of said hook and loop fastening means fixed to said second piece.

4. The holster of claim 1 wherein the second leg of said U-shaped member is curved so that the second leg is concave on the side distal of said pouch; said concavity generally cylindrical formed with the axis of the defining cylinder being perpendicular to the plane of the cross member.

5. The holster of claim 1 further including snap fastener means for fixing said first piece to said second piece.

6. The holster of claim 5 wherein said second piece defines first and second ends said first end fixable to said pouch by hook and loop fastening means, the hook portion of the hook and loop fastening means fixed to one side of said second piece adjacent the first end.

7. The holster of claim 6 wherein said snap fastener means includes a female snap socket fixed to said second piece at the second end thereof and so that the female socket is on the side opposite of said hook portion.

8. The holster of claim 7 wherein said first piece defines first and second ends and first and second sides; said first end having affixed thereto hook and loop fastening means, said hook portion of the hook and loop fastening means affixed adjacent said first end on said first side, and said loop portion affixed to the same first side of the hook and loop portion but distal of said first end;

said first end fixable to said rigid retainer means by passing said first end through said co-axial slots and then doubling said first end back over said cross member to engage said hook portion with said loop portion; and wherein said snap fastener means includes a double sided male snap, said double sided male snap affixed to said first piece adjacent to second end, so that one end of said double sided male snap may be engaged with said female socket of said snap fastener means.

9. The holster of claim 6 wherein said first piece defines first and second ends said first end fixable to said relatively semi-rigid pouch by hook and loop fastening means, the hook portion of the hook and loop fastening means fixed to one side of said second piece adjacent the first end.

10. The holster of claim 9 wherein said second piece defines first and second ends and first and second sides; said first end having affixed thereto hook and loop fastening means, said hook portion of the hook and loop fastening means affixed adjacent said first end on said first side, and said loop portion of the hook and loop portion affixed to the same first side, but distal of said first end;

said first end fixable to said rigid retainer means by passing said first end through said co-axial slots and then doubling said first end back over said cross member to engage said hook portion with said loop portion; and wherein said snap fastener means includes a double sided male snap, said double sided male snap affixed to said first piece adjacent to second end, so that one end of said double sided male snap may be engaged with said female socket of said snap fastener means.

* * * * *